United States Patent [19]

Wilson

[11] Patent Number: 4,751,891

[45] Date of Patent: Jun. 21, 1988

[54] BOW PROTECTOR

[76] Inventor: John T. Wilson, 427 Wilder Pl., Shreveport, La. 71104

[21] Appl. No.: 930,920

[22] Filed: Nov. 17, 1986

[51] Int. Cl.[4] ..... B63B 59/02

[52] U.S. Cl. ..... 114/219; 405/215

[58] Field of Search ..... 114/218, 219; 405/212, 405/215, 211; 293/102, 126, 128, 132, 136, 154

[56] References Cited

U.S. PATENT DOCUMENTS

| | | | |
|---|---|---|---|
| 461,759 | 10/1891 | Koch | 114/219 |
| 708,476 | 9/1902 | Higgins | 114/219 |
| 1,049,261 | 12/1912 | Pelissier | 114/219 |
| 1,130,809 | 3/1915 | Gerber | 114/219 |
| 1,361,902 | 12/1920 | Porteous | 114/219 |
| 1,781,403 | 11/1930 | Lyons | 114/219 |
| 1,852,240 | 4/1932 | Hill | 114/219 |
| 1,981,182 | 11/1934 | Lyons | 114/219 |
| 2,062,919 | 12/1936 | Maas | 114/219 |
| 2,905,129 | 9/1959 | Denend et al. | 114/219 |
| 2,965,407 | 12/1960 | Meisen | 114/219 |
| 3,055,022 | 9/1962 | Vallquist | 114/219 |
| 3,063,399 | 11/1962 | Schuyler | 114/219 |
| 3,220,026 | 11/1965 | Lichti | 114/219 |
| 3,261,320 | 7/1966 | Leonard | 114/219 |
| 3,270,701 | 9/1966 | Kubas | 114/121 |
| 3,455,269 | 7/1969 | Dean | 114/219 |
| 3,507,123 | 4/1970 | Miura | 114/219 |
| 4,267,792 | 5/1981 | Kimura et al. | 114/219 |

FOREIGN PATENT DOCUMENTS

| | | | |
|---|---|---|---|
| 2554142 | 5/1985 | France | 114/219 |
| 488 | 1/1983 | Japan | 114/219 |

OTHER PUBLICATIONS

Anchor Blue-Spot Fenders, Benfleet, Essex, England, Catalog 9/1984.

*Primary Examiner*—Joseph F. Peters, Jr.
*Assistant Examiner*—Stephen P. Avila
*Attorney, Agent, or Firm*—John M. Harrison

[57] ABSTRACT

A bow protector for protecting and cushioning the bow of watercraft such as sailboats, which includes a shaped, impact-receiving nose portion having a V-shaped inner angle for engaging the front edge of the bow and rearwardly extending arms designed to seat on opposite anterior surfaces of the bow. In a preferred embodiment the bow protector is provided with a longitudinal impact slot extending through the center of the nose portion and spaced ancillary impact slots also projecting through the nose portion and located adjacent to the central impact slot, in order to cushion impact forces received by the bow protector when the watercraft strikes a dock, another watercraft or any other relatively unyielding object. The bow protector is suspended on the bow of the watercraft by means of starboard and port elastic guy lines which extend through guy line openings provided in the bow protector and are anchored to cleats secured to the foredeck of the watercraft. The bow protector is particularly well designed to absorb and displace the shock of collision between angled bow sailboats and a dock or other object, by initially elastically deforming upon impact to perform a primary cushioning function and subsequently allowing the bow to ride upwardly with respect to the bow protector, in order to further dissipate the impact shock in a secondary shock-absorbing action.

29 Claims, 2 Drawing Sheets

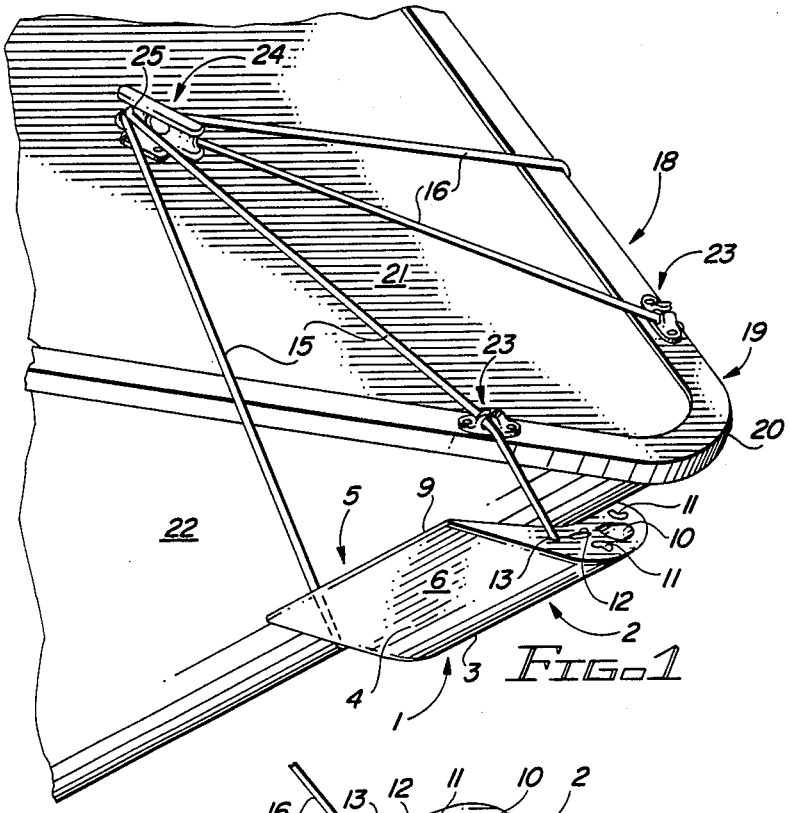
FIG. 1
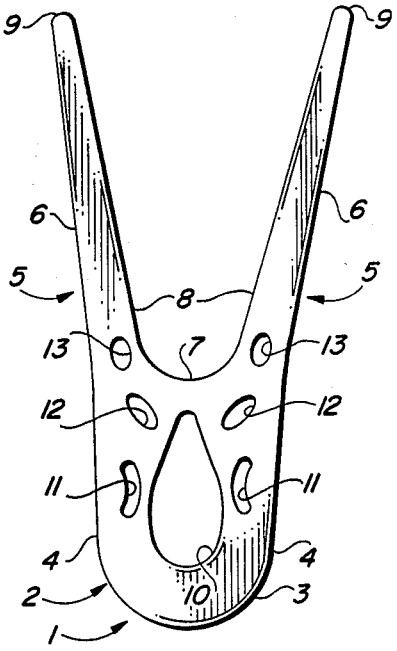
FIG. 2
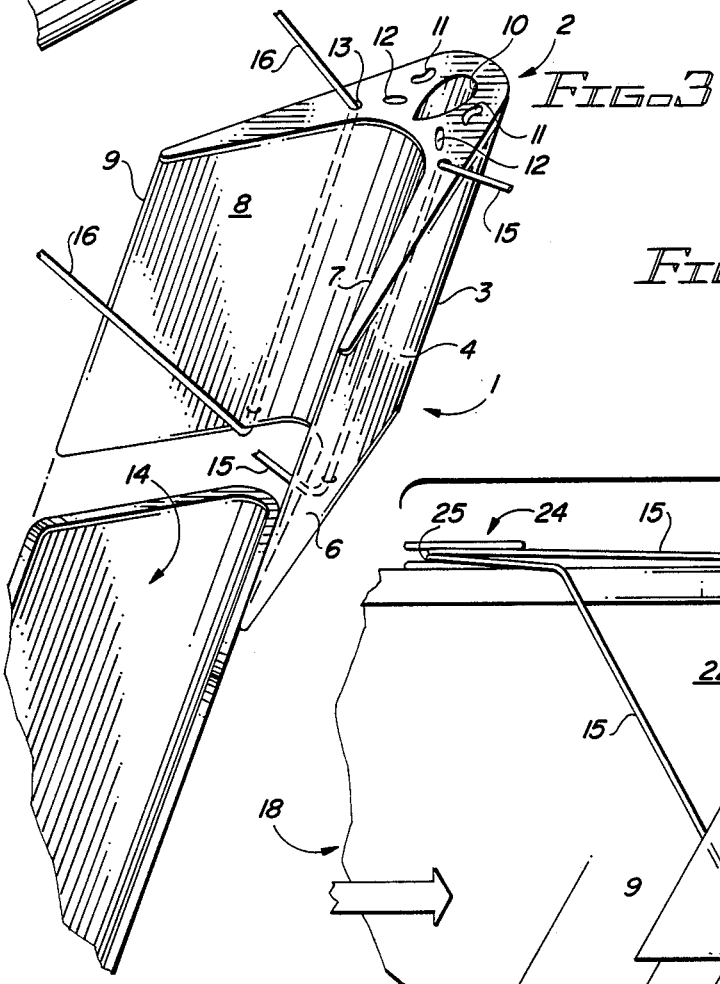
FIG. 3
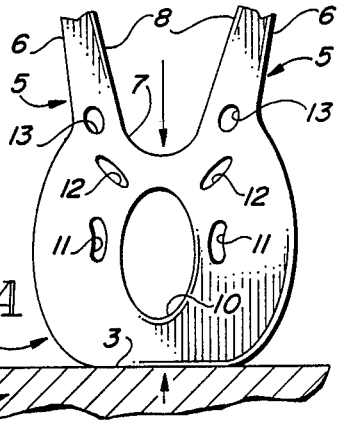
FIG. 2A
FIG. 4A
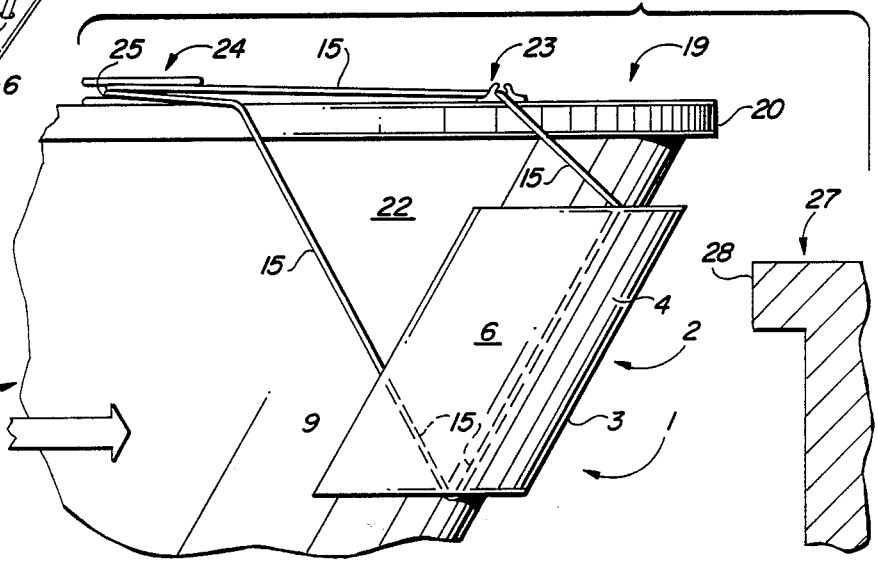

BOW PROTECTOR

BACKGROUND OF THE INVENTION

1. Field of the Invention

This invention relates to protective equipment for boats and watercraft and more particularly, to a bow protector for cushioning and protecting the slanted or angled bow and stem of watercraft such as sailboats from damage due to impact with docks, watercraft and other objects. The bow protector of this invention is characterized by a shaped, deformable nose portion provided with rearwardly extending arms which are designed to engage the anterior surfaces of the watercraft bow. In a preferred embodiment of the invention the nose and arms are integrally formed by extrusion or injection molding techniques and are provided with one or more longitudinally disposed impact slots which are designed to at least partially dissipate the forces generated when the bow protector strikes a relatively unyielding structure such as a dock. The bow protector is suspended against the bow of a watercraft by means of elastic starboard and port guy lines which are attached to a cleat mounted on the foredeck of the watercraft. This suspension technique, coupled with the resilient design of the bow protector, facilitates a dual means of dissipating shock resulting from impact between the bow protector and a dock or other object. This impact force is dissipated by initially elastically deforming the nose portion of the bow protector and subsequently causing the bow of the boat to move upwardly or downwardly with respect to the bow protector responsive to impact.

One of the problems realized in the docking of watercraft and boats such as sailboats, is that of easing the watercraft into the dock area without striking the dock and damaging the bow of the boat. This problem is intensified under circumstances where sailboats are docked under conditions of heavy wind, since it is very difficult to control the speed of a sailboat and the bow frequently strikes the dock, sometimes sustaining damage. Loss of control can also be realized when auxiliary outboard or inboard motors, which are used to aid in maneuvering sailboats at low speeds, suddenly stop operating. Since most sailboats are constructed of fiberglass, the bows are easily scratched and damaged by collision with a dock or another watercraft and unless the sailboat is fitted with a motor, docking without damaging the bow is sometimes extremely difficult. In addition to the problem of docking boats such as sailboats, the anterior areas of the slanted bows of these boats are frequently scratched or damaged due to scraping against a dock or another watercraft responsive to wave action. This scraping action sometimes occurs while a boat is moored in a slip or tied to a dock and may be intensified by one or more loose or broken ties.

2. Description of the Prior Art

Various types of bumpers, fenders and bow protective devices for watercraft are known in the art. An early "Fender for Vessels" is disclosed in U.S. Pat. No. 461,759, to J. T. C. Koch. This device is characterized by one or more rigid frames fixedly secured to the bow of a boat and provided with rubber cushion members, in order to absorb impact between the boat and another object such as a boat or dock. U.S. Pat. No. 708,476, dated Sept. 2, 1902, to W. H. Higgins, discloses another protective device, styled "Fender for Boats". The Higgins fender includes an upwardly curled shock absorbing device which is composed of rawhide cut into a suitable form and stuffed with a material such as "curled hair". The device folds around the bow and stem of the boat to provide a shock absorbing function and is fixed to the bow to prevent relative movement of the bow with respect to the fender, or vice-versa. A "Bumper" is disclosed in U.S. Pat. No. 1,049,261, dated Dec. 31, 1912, to F. Pelissier. The bumper device detailed in this patent includes three cylindrically-shaped shock absorbing bumpers which are ganged together in a triangular configuration on the bow of a boat and are fixedly secured in place by means of chains. U.S. Pat. No. 1,130,809, dated Mar. 9, 1915, to C. Gerber, discloses a "Ship Bow Shield and Shock Absorber". The disclosed shock absorber is characterized by a V-shaped metal shield spaced from the bow of a ship, with buffer bars slidably received in the bow of the ship and pivotally attached to the V-shaped shield. Spiral springs are carried by the buffer bars to normally maintain a space between the shield and the bow of the ship and to facilitate absorption of shock when the ship strikes an object such as a dock or another ship. U.S. Pat. No. 1,361,902, dated Dec. 14, 1920, to L. Porteous, discloses a "Bumper for Boats", which includes a sausage-shaped shock absorbing device provided with an air chamber and designed to keep the boat from rubbing against the walls of docks and other structures to which the boat may be moored. U.S. Pat. No. 3,063,399, dated Nov. 13, 1962, to F. B. Schuyler, discloses a "Bow Bumper for Tugs and Similar Boats". The bow bumper detailed in this patent is characterized by a V-shaped guard which is constructed of a resilient material such as rubber and engages the bow of a boat in fixed relationship, in order to prevent damage to the bow upon contact with a dock or another boat. The bow bumper is fixedly secured in place to prohibit relative movement between the bumper and the boat. A similar bumper device is disclosed in U.S. Pat. No. 1,981,182, dated Nov. 20, 1934, to C. T. Lyons. The "Marine Fender" detailed in this patent includes a resilient front block portion with rearwardly extending side block panels for fitting to the bow of a boat in fixed relationship, in order to prevent damage to the bow upon contact with a dock, another boat or any other object. Another "Marine Fender" is disclosed is U.S. Pat. No. 3,261,320, dated July 19, 1966, to F. O. Leonard. The marine fender of this invention is characterized by a resilient cushioning member having a hollow interior and disposed on the bow of a boat, in order to cushion the bow upon impact with another object. The dock fender is secured to the bow in fixed relationship by one or more unitary brackets and chains. A "Ship's Fender" is disclosed in U.S. Pat. No. 1,781,403, dated Nov. 11, 1930, to C. T. Lyons. This device is characterized by multiple disks cut from rubber tires, with clamping rods passed through the disks to form a fender section and a holding member extending through a series of these sections to define a fender. The device is attached to the bow of a boat in fixed relationship by means of three anchor chains. U.S. Pat. No. 1,852,240, dated Apr. 5, 1932, to M. Hill, discloses another "Ship's Fender", which wraps around the bow of a boat and is secured in fixed position by turnbuckles and a harness. The ship's fender includes a first resilient section and a second resilient, but durable lining section which is wear-resistant and is sandwiched between the first resilience section and the bow of the boat. U.S. Pat. No. 3,055,022, dated Sept. 25, 1962, to V. P. Vallquist and U.S. Pat. No. 3,220,026, dated Nov. 30, 1965, to A. W. Lichti, both disclose boat beaching aprons and hull protectors for protecting the bow and bottom area of a boat when the boat is beached. A similar protective device is disclosed in U.S. Pat. No. 3,270,701, dated Sept. 6, 1966, to Jay Kubas, which device is designed to stabilize a watercraft and minimize pitching and wave shock. Other fender structures for boats and docks are disclosed in U.S. Pat. No. 3,455,269, dated July 15, 1969, to D. L. Dean; U.S. Pat. No. 4,267,792, dated May 19, 1981, to Kimura; and U.S. Pat. No. 4,277,055, dated July 7, 1981, to Yamaguchi, et al.

Immovable, fixed boat fenders and shock-absorbing devices are incapable of efficiently, inexpensively, and reliably absorbing the shock of collision under a wide variety of circumstances and impact loads to minimize hull damage. These fixtures are also usually esthetically displeasing and are difficult to install, maintain and remove from a boat. The September 1984 issue of the Anchor Marine catalog, issued by Anchor Marine Products, Essex, England, discloses "Bow Fenders" which are generally rounded and triangular-shaped, with openings for mounting the fender on a boat. These fenders are designed for spot impact of apparent low intensity and do not have the grooved capability of sliding to dissipate impact forces by directing the forces upwardly or downwardly. Nor do these fenders protect a substantial portion of the bow or sides of a boat hull. These fenders are not attached to the boat by elastic cords and are therefore relatively stationary at the point of attachment. There are also no upper and lower edges that are substantially parallel to the deck and waterline.

It is an object of this invention to provide a bow protection device which is capable of performing a primary shock absorbing function by deforming to an elastic limit determined by the selected material of construction and is suspended on the slanted or angled bow of a boat in such a manner as to facilitate a secondary shock absorption function which utilizes the weight of the boat as the bow moves upward with respect to the bow protector device and further dissipates shock.

Another object of this invention to provide a new and improved resilient, impact-cushioning bow protector for watercraft, which bow protector is characterized by a deformable, shock-absorbing nose portion having rearwardly extending arms for engaging the anterior surfaces of the bow of a boat and is suspended on the bow by means of elastic guy lines, in order to facilitate relative movement between the boat and the bow protector for additional shock relief.

Still another object of the invention is to provide a new and improved light-weight bow protector for slidable suspension on a watercraft such as sailboat, which bow protector is characterized by a resilient, V-shaped cap member having an elastically deformable nose portion and rearwardly extending arms for engaging and conforming to the anterior surfaces of the bow, with at least one impact slot provided in the nose portion of the bow protector for absorbing at least a portion of the shock of impact with a dock or other object.

Yet another object of this invention is to provide a new and improved bow protector for boats and for sailboats having slanted or angled bows in particular, which bow protector is characterized by an extruded or molded rubber or plastic fender cap having a resilient, deformable nose portion and rearwardly extending arms integrally formed with the nose portion, the arms being adapted to engage the anterior surfaces of the bow of the sailboat, wherein the bow protector is suspended from the deck of the sailboat by elastic guy lines to facilitate shock-reducing, relative movement between the bow of the sailboat and the bow protector.

A still further object of this invention is to provide a new and improved bow protector for suspension on the bow of sailboats and other watercraft having an angled or slanted bow, which bow protector includes a resilient rubber or plastic fender characterized by a deformable nose portion provided with at least one impact slot therein and rearwardly extending arms for engaging and conforming to the anterior surfaces of the bow. Elastic starboard and port guy lines operate to suspend the bow protector against the bow of the watercraft, in order to facilitate relative movement between the bow protector and the watercraft to help reduce the shock of impact with a dock or other object.

Still another object of this invention is to provide a generally V-shaped sailboat bow protection device which is shaped from a resilient, elastically deformable material and is provided with a nose portion having multiple impact slots extending therethrough and openings for accommodating elastic guy lines which extend from the boat deck to suspend the bow protection device on the bow of the boat. A sleeve which can be fabricated of canvas or other suitable material is positioned between the bow protection device and the bow of the sailboat to facilitate relative movement between the bow and the bow protection device as a secondary shock absorption expedient.

SUMMARY OF THE INVENTION

These and other objects of the invention are provided in a new and improved, esthetically pleasing bow protector for preventing damage to the angled or slanted bow of a watercraft such as a sailboat, which bow protector is characterized by an elastically deformable, angularly cut nose portion having at least one longitudinally oriented impact slot therein and rearwardly extending arms integrally formed with the nose portion, for engaging the anterior surfaces of the bow. An elastic harness for suspending the bow protector against the bow of the boat is threaded through guy line openings located in the arms and secured to the deck of the boat in order to facilitate upward movement of the boat with respect to the bow protector upon impact with a dock or other object, to help absorb the force of impact. This shock-absorbing function is effected by a dissipation of the force upwardly or downwardly, depending upon the loading of the boat deck, by relative movement between the bow of the boat and the bow protector.

BRIEF DESCRIPTION OF THE DRAWING

The invention will be better understood by reference to the accompanying drawings, wherein:

FIG. 1 is a perspective view of a preferred embodiment of the bow protector of this invention located in functional position on the bow of a sailboat;

FIG. 2 is a top elevation of the bow protector illustrated in FIG. 1;

FIG. 2A is a top elevation of the bow protector illustrated in FIG. 2, more particularly illustrating elastic deformation of the bow protector in a primary shock-absorbing function upon impact with a dock;

FIG. 3 is a rear perspective view of the bow protector illustrated in FIG. 1, provided with an optional sleeve;

FIG. 4A is a side elevation of the bow protector illustrated in FIG. 1, with the sailboat and bow protector approaching a dock;

DESCRIPTION OF THE PREFERRED EMBODIMENTS

Figure 4B:
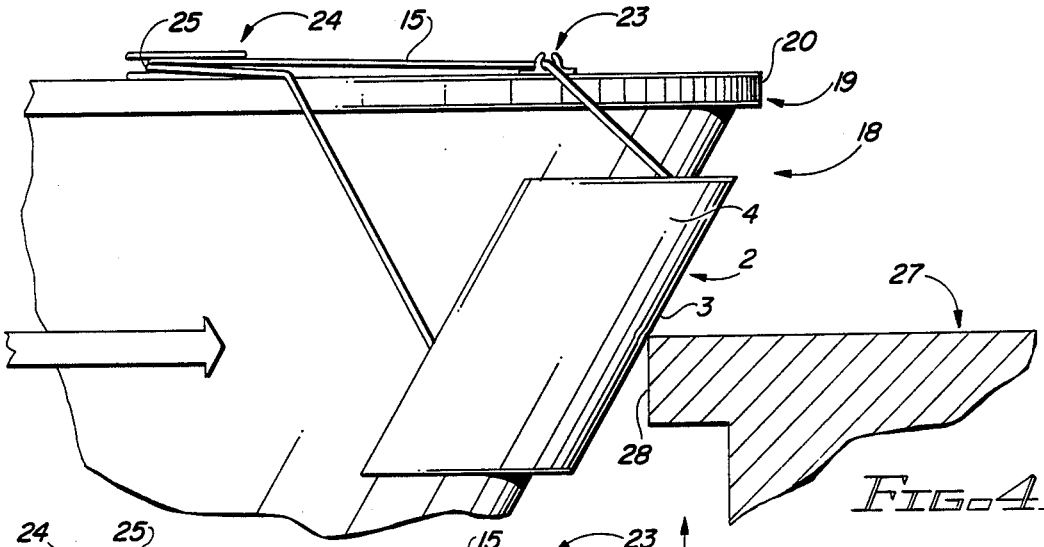
FIG. 4B is a side elevation of the bow protector and boat illustrated in FIG. 4A, more particularly illustrating initial impact between the bow protector and the dock.

Referring initially to FIGS. 1 and 3 of the drawings, in a preferred embodiment the bow protector of this invention is generally illustrated by reference numeral 1. The bow protector 1 is characterized by a blunt nose portion 2, having a rounded frontal margin 3 which extends rearwardly to define the slightly diverging side margins 4. A pair of arms 5 extend from the respective side margins 4 of the nose portion 2 and join at an inner angle 7, which defines a "V" and the inner faces 8 of the arms 5 correspond to the anterior surfaces 22 of the bow 19 of the boat 18. The inner angle 7 is defined by converging inner faces 8 of the arms 5. The arm faces 6 and inner faces 8 converge at the spaced rear edges 9, respectively, to define the outer edges 9 of each of the arms 5.

Referring now to FIGS. 1-3 of the drawings, in a most preferred embodiment of the invention a center impact slot 10 extends throughout the length of the nose portion 2 and a pair of smaller, kidney-shaped side impact slots 11 are disposed on either side of the center impact slot 10, as illustrated. A pair of generally elliptically-shaped rear impact slots 12 also extend through the entire length of the nose portion 2 rearwardly of the side impact slots 11. A pair of spaced guy line openings 13 project through the base of the arms 5, in order to receive the starboard guy line 15 and the port guy line 16, for suspending the bow protector 1 against the bow 19 of the boat 18 in sliding relationship, as illustrated in FIGS. 1 and 3. Furthermore, in yet another preferred embodiment of the invention, a sleeve 14 is glued or otherwise attached to the inner angle 7 and inner faces 8 of the arms 5, in order to provide a surface of reduced friction contacting the anterior surfaces 22 of the bow 19, to facilitate easy movement of the bow 19 with respect to the bow protector 1.

Referring now to FIGS. 1, 3 and 4A of the drawings, in another most preferred embodiment of the invention the starboard guy line 15 and port guy line 16 are threaded through the guy line openings 13, respectively, and the top ends of the starboard guy line 15 and port guy line 16 are each placed in spaced-apart bow chocks 23. The ends of both the starboard guy line 15 and the port guy line 16 are then overlapped around the aft portion 25 of a foredeck cleat 24 and are secured to the foredeck cleat 24, as illustrated in FIGS. 1 and 4A. The bow chocks 23 are mounted on the stem 20 and the foredeck cleat 24 is secured to the foredeck 21 of the boat 18, in order to securely, but adjustably, suspend the bow protector 1 against the bow 19 of the boat 18. It is understood that the starboard guy line 15 and port guy line 16 can be secured to any cleat or fixture located on the foredeck 21 of the boat 18, so long as the bow protector 1 is freely suspended on the bow 19, as illustrated in the drawings.

Figure 4C:
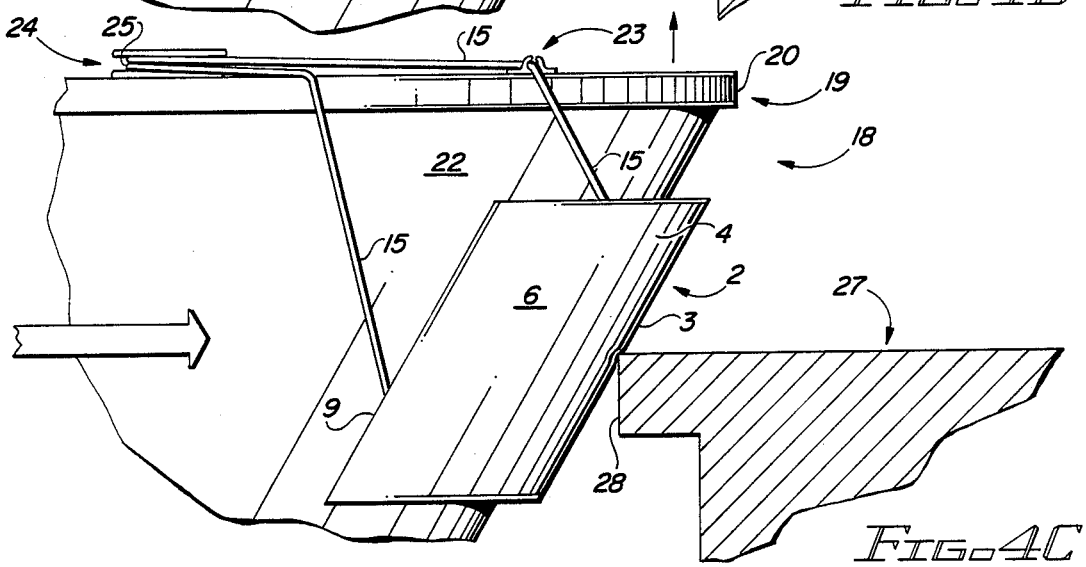
FIG. 4C is a side elevation of the bow protector illustrated in FIGS. 4A and 4B, more particularly illustrating upward movement of the bow of the sailboat with respect to the bow protector and the dock in a secondary shock-absorbing function.
Figure 4D:
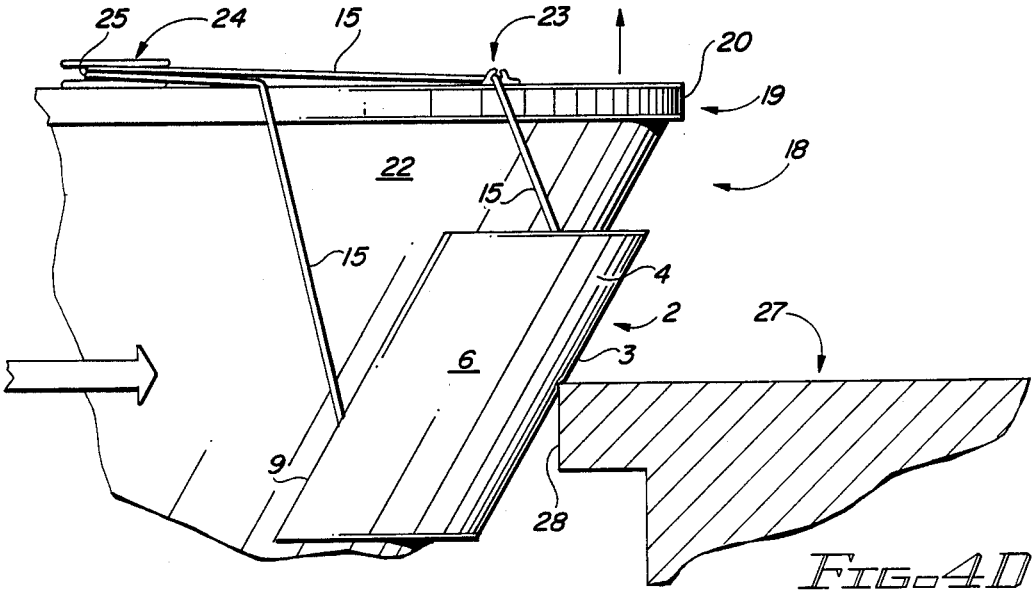
FIG. 4D is a side elevation of the bow protector illustrated in FIGS. 4A through 4C, more particularly illustrating maximum rise of the sailboat bow with respect to the bow protector and dock responsive to complete upward dissipation of the force of impact.

In operation and referring initially to FIG. 4A of the drawings, as the boat 18 approaches a dock 27, fitted with a dock margin 28, the nose portion 2 of the bow protector 1 is aligned with the dock margin 28. Furthermore, as illustrated in FIGS. 2 and 4B, when the nose portion 2 of the bow protector 1 contacts the dock margin 28, the nose portion 2 elastically deforms, as indicated in FIG. 2A, in a primary shock-absorbing function, to help absorb the force generated by the initial impact. This deformation results in a rounding of the center impact slot 10 and the side impact slots 11, with a narrowing of the rear impact slots 12, to optimize the absorption and dissipation of shock as the boat 18 moves closer to the dock 27. As the nose portion 2 of the bow protector 1 continues to elastically deform to a maximum extent responsive to the force generated by impact with the dock margin 28, the arms 5 flare slightly away from the anterior portion 22 of the bow 19 and the bow 19 begins to move upwardly with respect to the bow protector 1, as illustrated in FIG. 4C. This upward movement of the bow 19 inside the bow protector 1 constitutes a secondary shock absorption reaction which is responsive to the force resulting from the impact and is facilitated by the elastic starboard guy line 15 and port guy line 16, which do not rigidly attach the bow protector 1 to the bow 19. Since the bow protector 1 is fixed relative to the dock margin 28 of the dock 27 by deformation of the nose portion 2, it cannot rise. Accordingly, the additional impact shock over and above that which is expended in deforming the nose portion 2 is dissipated by the weight of the boat 18 in the secondary displacement shock absorbing action facilitated by the upward sliding movement of the bow 19 within the bow protector 1. Additional movement of the boat 18 toward the dock 27 results in continued rising of the bow 19 with respect to the bow protector 1 as illustrated in FIG. 4D, until the shock of impact is completely neutralized by the weight of the boat 18 and the bow 19 again rides downwardly inside the bow protector 1, to the position illustrated in FIG. 4A.

It will be appreciated by those skilled in the art that the bow protector of this invention can be constructed of any resilient material known to those skilled in the art which is capable of performing a shock-absorbing function. Accordingly, in yet another preferred embodiment of the invention, the bow protector 1 is characterized by a rubber material which is capable of being extruded in one piece and in selected lengths. Alternatively, the bow protector 1 can be constructed of a thermoplastic or thermoresin material which is capable of being injection-molded into the desired shape. Other materials such as cork, rope, wood and like material, in non-exclusive particular, which are capable of elastically deforming, can be used according to the teaching of this invention, so long as the bow protector created by the desired material is suspended on the bow of the boat in such a manner as to permit relative movement between the bow and the bow protector itself. These materials can be provided in layers or placed in a container such as a bag or sheath, to define a desired configuration. Accordingly, as heretofore described and referring again to the drawings, a key feature of the invention is this relative movement of the bow 19 of the boat 18 within the bow protector 1 in order to facilitate a secondary shock absorbing function which operates to allow the bow 19 to move upwardly in order to dissipate excessive shock beyond that which is required to deform the nose portion 2 of the bow protector 1 to its elastic limit from impact with the dock, watercraft or other object.

Referring again to FIGS. 1 and 3 of the drawings, it will be appreciated that the bow protector 1 can be manufactured of any desired length, in order to protect the entire anterior surface 22 or any portion thereof, from the waterline to the stem 20. Alternatively, multiple units of the bow protector 1 can be suspended together by threading the starboard guy line 15 and port guy line 16 through registering guy line openings 13 in the respective arms 5. The starboard guy line 15 and port guy line 16 can also be passed through any combination of the center impact slot 10, side impact slots 11 and rear impact slots 12, in order to secure the bow protector 1, or multiple units of the bow protector 1 to the bow 19 of a boat 18. In a most preferred embodiment of the invention, multiple units of the bow protector 1 are connected in end-to-end relationship by passing connecting lines (not illustrated) through the side impact slots 11 and/or rear impact slots 12 and tying these lines together. The starboard guy line 15 and port guy line 16 are extended through the guy line openings 13, as illustrated. Furthermore, the inner angle 7 can be varied during the manufacturing process to accommodate the bow of any watercraft.

It will also be appreciated by those skilled in the art that the bow protector of this invention is durable and self-centering on the bow of a boat when suspended by means of the starboard guy line 15 and port guy line 16. The bow protector 1 is esthetically pleasing in design, since it conforms generally to the parallel lines of the boat deck, bow and waterline, and it can also be provided in any color, length, and inner angle and arm size, to protect a watercraft and sailboat of any design. Furthermore, the device is inexpensive and easy to manufacture from a wide variety of elastically deformable materials.

Referring again to FIGS. 1 and 3 of the drawings it is understood that non-elastic lines can be used to secure the bow protector 1 in place, instead of the starboard guy lines 15 and port guy lines 16, particularly under circumstances where the boat 18 is moored in a slip or to a dock and the bow protector 1 serves primarily as a bumper or fender to absorb minor impact forces. Under these circumstances there is no need for extensive relative movement between the bow 19 and the bow protector 1, which the elastic starboard guy line 15 and port guy line 16 are designed to facilitate. Furthermore, while ropes and lines of various character and description can be threaded through the guy line openings 13 or the center impact slot 10, side impact slots 11 or rear impact slots 12, as heretofore noted, the lines can also be attached to the bow protector 1 by means of grommets (not illustrated) or other means, according to the knowledge of those skilled in the art.

It will also be appreciated by those skilled in the art that the bow protector 1 can be utilized on boats and watercraft which do not utilize a slanted or angled bow design. Under these circumstances the bow protector 1 can be modified such that the top and bottom edges of the nose portion 2 and arms 5 are oriented parallel to the boat deck and the waterline when the inner angle 7 is snugged against the bow.

While the preferred embodiments of the invention have been described above, it will be recognized and understood that various other modifications may be made therein and the appended claims are intended to cover all such modifications which may fall within the spirit and scope of the invention.

Having described my invention with the particularly set forth above, what is claimed is:

1. A bow protector for protecting the bow and other areas of a watercraft from damage resulting from contact with an object, said bow protector comprising an elongated, deformable nose portion; a pair of arms projecting from said nose portion in angular relationship, said nose portion and said arms terminating in a top edge and a bottom edge and said nose portion and said arms substantially conforming to the bow; and a first line opening extending longitudinally through one of said arms and a second line opening extending longitudinally through the other of said arms, for receiving at least one line and securing said bow protector to the bow in slidable relationship, whereby the bow of the watercraft is slidably displaced with respect to said bow protector to at least partially absorb the impact of shock responsive to contact with the object.

2. The bow protector of claim 1 wherein said top edge and said bottom edge of said nose portion and said arms are substantially parallel to each other and to the waterline of the watercraft.

3. The bow protector of claim 1 wherein said line is further characterized by a starboard line and a port line attached to said line attachment means, respectively.

4. The bow protector of claim 3 wherein said starboard line and said port line are elastic.

5. The bow protector of claim 3 wherein said top edge and said bottom edge of said nose portion and said arms are substantially parallel to each other and to the waterline of the watercraft.

6. The bow protector of claim 5 wherein said starboard line and said port line are elastic.

7. The bow protector of claim 1 further comprising at least one impact slot means provided in said nose portion for partially absorbing a force applied to said bow protector.

8. The bow protector of claim 7 wherein said at least one impact slot means is a generally elliptically-shaped center impact slot extending longitudinally substantially through the center of said nose portion.

9. The bow protector of claim 1 wherein:

(a) said top edge and said bottom edge of said nose portion and said arms are substantial to parallel to each other and to the waterline of the watercraft; and (b) said line is further characterized by a starboard line extending through said first line opening and a port line extending through said second line opening for slidably securing said bow protector to said bow; and further comprising at least one center impact slot extending longitudinally substantially through the center of said nose portion.

10. The bow protector of claim 9 wherein said impact slot is generally elliptical in cross-section.

11. The bow protector of claim 9 wherein said starboard line and said port line are elastic.

12. The bow protector of claim 9 further comprising a pair of side impact slots extending longitudinally through said nose portion on opposite sides of said center impact slot.

13. The bow protector of claim 9 further comprising a pair of rear impact slots extending longitudinally through said nose portion in spaced relationship with respect to each other between said center impact slot and said arms, respectively.

14. The bow protector of claim 9 further comprising:

(a) a pair of side impact slots extending longitudinally through said nose portion on opposite sides of said center impact slot; and (b) a pair of rear impact slots extending longitudinally through said nose portion in spaced relationship with respect to each other between said center impact slot and said arms, respectively.

15. The bow protector of claim 14 wherein said starboard line and said port line are elastic.

16. A bow protector for protecting the bow of a boat from damage resulting from contact with an object, said bow protector comprising an elongated, substantially resilient nose portion; a pair of substantially resilient arms extending from said nose portion in angular relationship to define a generally V-shaped pocket substantially conforming to the bow of the boat, said nose portion and said arms terminating in a generally V-shaped top edge and a generally V-shaped bottom edge; and a first line opening extending longitudinally through one of said arms and a second line opening extending longitudinally through the other said arms for receiving at least one line and securing the bow protector to the bow in slidable relationship, whereby the bow of the watercraft is slidably displaced with respect to said bow protector to at least partially absorb the impact of shock responsive to contact with the object.

17. The bow protector of claim 18 wherein said line is further characterized by a starboard line and a port line attached to said line attachment means, respectively.

18. The bow protector of claim 17 wherein said starboard line and said port line are elastic.

19. The bow protector of claim 18 further comprising at least one impact slot means provided in said nose portion for partially absorbing a force applied to said bow protector.

20. The bow protector of claim 19 wherein said at least one impact slot means is a generally elliptically-shaped center impact slot extending longitudinally substantially through the center of said nose portion.

21. The bow protector of claim 20 further comprising a pair of side impact slots extending longitudinally through said nose portion on opposite sides of said center impact slot.

22. The bow protector of claim 21 further comprising a pair of rear impact slots extending longitudinally through said nose portion in spaced relationship with respect to each other between said center impact slot and said arms, respectively.

23. The bow protector of claim 16 further comprising sleeve means disposed between said nose portion and said arms and the bow of the boat for enhancing said sliding relationship.

24. A bow protector for protecting the slanted or angled bow of a boat from damage resulting from collision with an object, said bow protector comprising an elongated, substantially deformable and shock-resisting nose portion; a pair of substantially deformable and shock-resisting arm panels projecting from said nose portion in angular relationship to define a bow protector angle which corresponds substantially to the angle of the bow of the boat, said arm panels and said nose portion terminated at each end by a generally V-shaped top end and a generally V-shaped bottom end; and a pair of line attachment openings provided in said arms in longitudinal relationship, for receiving at least one line and snugly and slidably securing said bow protector to said bow, whereby the bow of the boat protector is easily slidably displaced with respect to said bow protector responsive to contact between said bow protector and the object, to dissipate the shock of collision.

25. The bow protector of claim 24 further comprising at least one impact slot provided in longitudinal relationship in said nose portion for partially absorbing the shock of collision.

26. The bow protector of claim 24 wherein said line is further characterized by an elastic starboard line and an elastic port line attached to said line attachment openings, respectively.

27. The bow protector of claim 25 wherein said at least one impact slot is a generally elliptically-shaped center impact slot further comprising a pair of side impact slots extending longitudinally through said nose portion on opposite sides of said center impact slot and a pair of rear impact slots extending longitudinally through said nose portion in spaced relationship with respect to each other between said center impact slot and said arms, respectively.

28. The bow protector of claim 24 further comprising sleeve means disposed between said nose portion and said arms and the bow of the boat for enhancing sliding displacement of said bow protector along the bow.

29. The bow protector of claim 27 wherein said line is further characterized by an elastic starboard line and an elastic port line attached to said line attachment openings, respectively and further comprising a sleeve carried by said nose portion and said arms and disposed between said nose portion and said arms and the bow of the boat for enhancing sliding displacement of said bow protector along the bow.

* * * * *